United States Patent [19]

Vrable

[11] Patent Number: 4,487,672

[45] Date of Patent: Dec. 11, 1984

[54] METHOD FOR DECREASING CORROSION OF INTERNAL SURFACES OF METALLIC CONDUIT SYSTEMS

[75] Inventor: John B. Vrable, Delmont, Pa.

[73] Assignee: United States Steel Corporation, Pittsburgh, Pa.

[21] Appl. No.: 438,130

[22] Filed: Nov. 1, 1982

[51] Int. Cl.[3] ..... C23F 13/00

[52] U.S. Cl. ..... 204/148; 138/37; 204/147

[58] Field of Search ..... 204/147, 148, 196, 197, 204/279; 138/37, 39

[56] References Cited

U.S. PATENT DOCUMENTS

| | | | |
|---|---|---|---|
| 56,905 | 8/1866 | Copeland | 138/37 |
| 439,888 | 11/1890 | McElroy | 138/37 |
| 1,613,461 | 1/1927 | Johnson | 204/197 |
| 2,523,443 | 9/1950 | Mogck | 204/197 |
| 3,175,571 | 3/1965 | Bankert | 138/39 |
| 3,334,660 | 8/1967 | Kappus | 138/39 |
| 3,445,370 | 5/1969 | Sherman | 204/197 |
| 3,477,930 | 11/1969 | Crites | 204/197 |
| 3,616,419 | 10/1971 | Bagnulo | 204/197 |
| 3,791,414 | 2/1974 | Anand et al. | 138/37 |
| 4,275,766 | 6/1981 | Aronson | 138/37 |

*Primary Examiner*—T. Tung

*Attorney, Agent, or Firm*—Arthur J. Greif

[57] ABSTRACT

Large diameter pipes or culverts carrying water or other corrosion producing liquids are cathodically protected by securing, spaced-apart, segment-like elements along the bottom inner (invert) surface of the pipe to effect a partial damming of the liquid therein, causing such surface to remain wet during periods in which the input of liquid is substantially decreased or halted. The achievement of such a continuously wet invert surface provides continuous electrolyte conduction, resulting in both (a) enhanced corrosion protection and (b) greater efficiency in use of the protective anodes.

9 Claims, 3 Drawing Figures

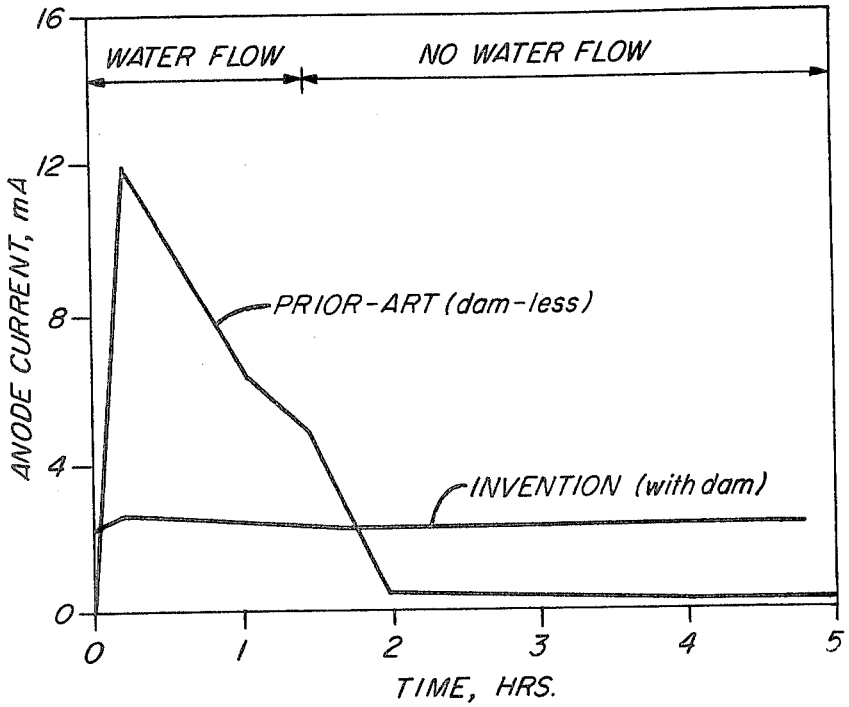
FIG. 1
FIG. 2
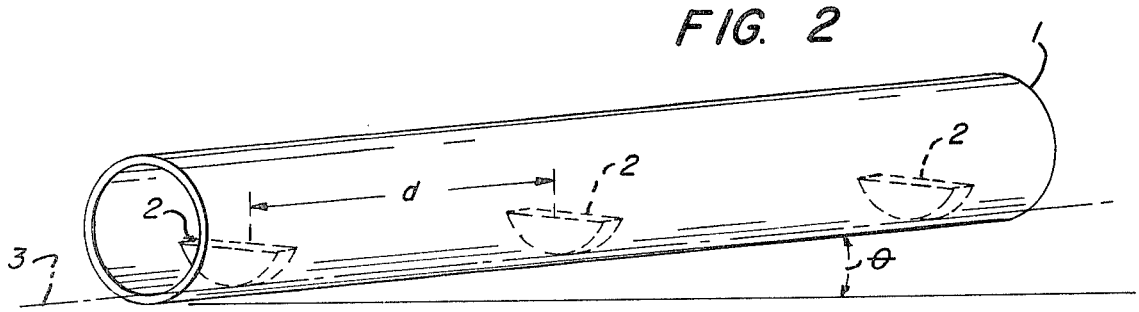
FIG. 3
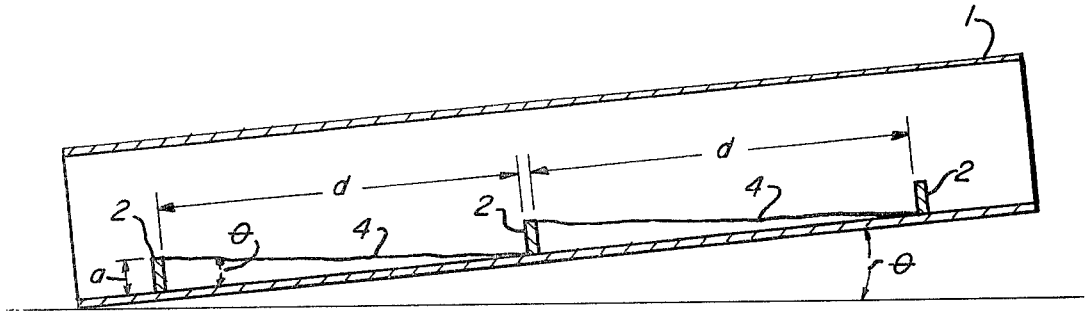

METHOD FOR DECREASING CORROSION OF INTERNAL SURFACES OF METALLIC CONDUIT SYSTEMS

This invention relates to a method for increasing the efficiency and effectiveness of anodic and cathodic corrosion protection systems used in protecting the inner surfaces of metallic piping used as conduits for water or other corrosive liquids and, in its most specific embodiment, is directed to protection of corrugated steel pipe used as a conduit to convey water.

Long years of experience with corrugated steel pipe systems show that their service life will vary from just a few months to an almost indefinite time period, depending on both the corrosive action of the water and the abrasive action of the particles conveyed therewith, in the pipe system. Galvanized (zinc coated) pipe is generally the standard for corrugated steel pipe systems used in drainage applications such as highway culvert and storm sewer drains. In addition to the galvanic protection offered by the zinc coating, the art has resorted, in attempts to improve the performance of such pipe, to measures such as the use of protective paint-type coatings and/or increasing the thickness of the pipe employed. Nevertheless, damage to the inside surface of corrugated steel pipe, particularly to the lower quadrant thereof (invert surface), continues to be a serious problem in obtaining required service life for such systems. It has now been found, with respect to conduit systems subject to an intermittent flow of corrosive liquids, that the corrosion protection provided, either by cathodic or anodic systems, can be substantially enhanced by the provision along the length of the interior of the conduit of what may be termed partial-dams. Such damming of the flow of the liquid serves two basic purposes, (i) it provides a substantially continuous electrolyte, necessary for the passage of protective current, especially when the flow of corrosive liquid is halted (e.g. for culverts, during periods of dry weather) and (ii) with respect to culverts, etc., the damming of the water slows the flow thereof, resulting in precipitation of sand and silt on the invert surface—providing a buffer layer which acts to protect the invert surface against damage from abrasive particles that may be transported through the culvert by the water flow.

These and other advantages of the instant invention will become more readily apparent from a reading of the following description, when taken into conjunction with the appended claims and the drawings in which:

FIG. 1 is a graph comparing anode current outputs (in a laboratory experiment), of cathodically protected pipe using a prior-art cathodic protection system, with and without the instant invention, and FIG. 2 is a perspective illustration of the use of the instant invention for the protection of the interior of culvert systems, showing a preferred shape of the anode/dam for achieving such protection.

FIG. 3 is a side-view of the system above showing how the preferred minimum dam height is a function of the pipe-inclination and the distance between dam elements.

A laboratory test was conducted to evaluate the efficiency of (i) the instant invention in comparison to that of a (ii) prior-art galvanic-anode system, as shown in U.S. Pat. No. 3,616,419, and (iii) an unprotected system. A water recycle loop was employed to circulate a corrosive, aqueous solution of 0.1% NaCl through three 4-inch-diameter pipes. Each pipe was 18" long and was prepared from plastic pipe lined with an 8-mil-thick mild-steel liner. One of the test pipes was unprotected to serve as a control. The other two pipes were cathodically protected, using a zinc-ribbon anode, in accord with the teachings of U.S. Pat. No. 3,616,419. Of the two protected pipes, one was fitted with a plastic circular-segment, attached near the outlet to create a partial dam in accord with the teachings of this invention. The anodes were prepared from commercially available zinc ribbon and their composition met the ASTM B 418-73, Type II Specification. The ribbon anode was a wrought product with a galvanized steel wire core. The steel wire core was exposed on one end, and an 0.1-ohm shunt was attached to permit measurement of the anode-current output. A short length of copper wire was used to make connection above the water surface with both the anode shunt and the edge of the steel liner. A thick plastic tape was wrapped around the anode at three points to prevent the anode from contacting the liner directly. Each liner was carefully cleaned and weighed prior to attachment to the pipe. After the test was completed, the liners were removed, again cleaned and reweighed. The test pipes were installed (in the lower tank of water loop) with the same slight negative slope. The water-flow rate to each pipe was set at initial value of 12 ml/sec. As water level in an upper storage tank dropped, the water flow rate decreased until finally there was no flow after approximately 1.5 hours. This "no-flow" state was then maintained for 3.5 hours. A pump was then automatically activated and the water pumped back to the storage tank and the cycle restarted. This recycling was continued over a two-week test period. At various times during this two-week period, anode current vs. time was measured for a complete, flow/no-flow cycle for both of the protected liners. A typical anode current output during one such complete cycle is shown in FIG. 1. As shown therein, it is seen that the anode current output with the prior-art (dam-less) system is dependent on whether or not water is flowing in the pipe. Thus, the low-current output condition encountered after about two hours in the dam-less system means little cathodic protection is being afforded. The decreased protection resulting therefrom was also borne out by the weight loss as encountered over the entire two-week period:

| Steel Liner Weight Loss (2 wks.) | |
|---|---|
| (i) Invention (protected + dam) | 0.2 gms. |
| (ii) Protected (Dam − less) | 1.8 gms. |
| (iii) Unprotected | 3.5 gms. |

Somewhat unexpectedly, in addition to enhanced corrosion protection, it was also found that the instant system provided increased anode-use efficiency as well. Thus, referring to FIG. 1, it is seen that use of the dam resulted in substantially steady current flow from the anodes; whereas without the dam, the initial rush of water resulted in a substantially higher initial anode current output (probably due to a decrease in concentration polarization), which higher output was substantially wasted, i.e. by supplying protective currents well above that necessary to achieve effective cathodic protection.

Although a damming effect could be provided by elements composed of a variety of materials (including non-metals), it is generally more practical that the dams be fabricated from metals less noble than that of the pipe being protected, whereby the dam elements serve a dual function—both as sacrificial anodes and as dams. A preferred system for achieving such dual function is shown in FIG. 2, in which pipe 1 is protected by segment-like elements 2, attached to the invert surface, such that radial altitude of the segments is orthogonal to the linear axis 3 of the invert surface. To achieve the objects of the instant invention, it is desirable that the height or altitude a of the segments and their spaced-apart distance d (measured along axis 3) be such that the amount of water which is dammed is about sufficient to maintain the invert portions between the dams in a substantially continuously wet condition. Disregarding loss of water due to evaporation, if the pipe or culvert were placed so as to lie on a grade which is substantially horizontal, the altitude of the segment-like elements could be quite small (e.g., at least 0.05 times the I.D. of the pipe), and the distance d between such elements could be quite large and nevertheless provide for a continuous wet-layer over the invert section. It may be seen from FIG. 2 that the minimum altitude of the segments, required to provide a level of water 4 separated therefrom by a distance d, is a function of the angle $\theta$ at which the pipe is inclined and is approximated by:

$$a = d \times \tan \theta$$

since tangent $\theta$ is related to the grade g by the equation $\tan \theta = g(\%)/100$; to achieve the full benefits of the instant invention it is desirable that the height or altitude of the segments be not substantially less than that determined by:

$$a = d \times g/100.$$

It should be recognized, however, that the above calculation considers only one function of the segments, i.e. in their action as partial dams. However, if the segments are also to act as sacrificial anodes, their spacing is not only governed by the requirement of providing a continuous wet layer, but also by the inherent throwing power of each anode, in order to provide galvanic protection coverage over a distance at least half way between the distances between the anodes. This maximum distance, imposed by throwing power will depend on the composition of pipe and, more importantly, the nature and composition of the anode materials. As a general rule, it is preferable that the distance between anodes be less than 8 times the inner diameter (I.D.), in feet, of the pipe itself, particularly in the case of pipe made from mild steel having an inner diameter of 1 to 4 ft., and anodes of substantially pure zinc.

To achieve requisite damming, the bottom arcuate portion of the damming elements, whether they be circular segments, as shown, or of analogous form, will substantially conform to the arcuate (invert) surface of the pipe, such that the long axis of the element (i.e. the chord of a circular segment) be substantially perpendicular to the invert linear axis 3. With pipe having a smooth surface, this is readily achieved. However, as noted above, most of the conduits used for highway culvert and storm sewer applications are made from corrugated steel pipe, in which case it is desirable that the arcuate portion of the segments be shaped to conform to the corrugations and curvature of the pipe, such that the arcuate bottom portion of the anode would be cast with a concave section adapted to fit the convex spiral corrugations of the pipe.

I claim:

1. In a method for protecting an extended length of a metal pipe having an inner diameter of 1 to 4 feet, said pipe having intermittent flow of corrosive liquids of a nature which results in the drying of the invert surface thereof, and said invert surface having its corrosion potential altered to decrease the corrosion rate of said surface, the improvement which comprises providing segment-like elements having an arcuate portion, (i) lying on the invert surface of the pipe and (ii) spaced from each other, along the linear axis of the invert surface, wherein the arcuate portion conforms to the invert surface of the pipe, so as to dam the flow of the liquid along said linear axis and prevent the liquid from completely emptying during the periods when the input thereof is substantially decreased, wherein the central altitude, a, of said segment-like elements is (i) not so high as to prevent the pipe from functioning as a conduit for said liquid, (ii) is at least 0.05 times the pipe I.D., in feet, and (iii) is not substantially less than that determined by:

$$a = d \times g/100,$$

where d is the spaced-apart distance, in feet, between said elements and g is the grade, in percent, at which the pipe length is sloped from the horizontal, and g is less than 3%.

2. The method of claim 1, wherein said metal is steel and said elements are composed of a metal less noble than steel.

3. The method of claim 2, wherein d is less than eight times the I.D., in feet, of said pipe.

4. The method of claim 3, wherein the pipe is corrugated pipe such that said invert surface along said invert linear axis exhibits peaks and valleys.

5. The method of claim 4, wherein the long axis of said segment-like elements is substantially perpendicular to said invert linear axis.

6. The method of claim 1, wherein said metal is steel and the corrosion potential of the invert surface thereof is altered by a coating thereon, said coating consisting essentially of zinc, aluminum or mixtures thereof.

7. The method of claim 6, wherein said elements are composed of a metal less noble than that of said coating.

8. The method of claim 6, wherein said coating is a galvanized coating.

9. The method of claim 5, wherein said pipe is employed as a culvert for drainage and said liquid consists essentially of water.

* * * * *